US006706143B1

(12) United States Patent
Tsai

(10) Patent No.: US 6,706,143 B1
(45) Date of Patent: Mar. 16, 2004

(54) MINIMIZING CHLORINATED ORGANICS IN PULP BLEACHING PROCESSES

(75) Inventor: Ted Y. Tsai, Harriman, NY (US)

(73) Assignee: International Paper Company, Purchase, NY (US)

( * ) Notice: Subject to any disclaimer, the term of this patent is extended or adjusted under 35 U.S.C. 154(b) by 0 days.

(21) Appl. No.: 09/609,513

(22) Filed: Jul. 3, 2000

Related U.S. Application Data

(63) Continuation of application No. 09/149,313, filed on Sep. 8, 1998, now abandoned, which is a continuation of application No. 08/617,612, filed on Mar. 19, 1996, now abandoned.

(51) Int. Cl.[7] ..... D21C 9/14; D21C 9/147; D21C 9/16

(52) U.S. Cl. ..... 162/65; 162/76; 162/78; 162/80; 162/88; 162/89

(58) Field of Search ..... 162/65, 67, 78, 162/80, 88, 89, 76

(56) References Cited

U.S. PATENT DOCUMENTS

| | | | | |
|---|---|---|---|---|
| 2,347,434 A | | 4/1944 | Reichert et al. | |
| 3,251,731 A | | 5/1966 | Gard | |
| 3,539,445 A | | 11/1970 | Crossland | |
| 3,619,110 A | * | 11/1971 | Borezee et al. | 162/78 |
| 3,694,309 A | | 9/1972 | Glerer et al. | |
| 4,238,282 A | | 12/1980 | Hyde | |
| 4,568,420 A | | 2/1986 | Nonni | |
| 4,599,138 A | | 7/1986 | Lindahl | |
| 4,675,076 A | | 6/1987 | Darlington | |
| 4,732,650 A | | 3/1988 | Michalowski et al. | |
| 4,804,440 A | | 2/1989 | Liebergott et al. | |
| 4,826,567 A | | 5/1989 | Gratzl | |
| 4,826,568 A | | 5/1989 | Gratzl | |
| 4,938,842 A | | 7/1990 | Whiting et al. | |
| 4,946,556 A | * | 8/1990 | Prough | 162/65 |
| 5,143,580 A | * | 9/1992 | Basta et al. | 162/78 |

FOREIGN PATENT DOCUMENTS

| | | | | |
|---|---|---|---|---|
| EP | 0 622 491 A2 | | 11/1994 | |
| EP | 622 499 | * | 11/1994 | 162/76 |
| WO | WO 91/12369 | | 8/1991 | |
| WO | 95/27100 | * | 10/1995 | 162/76 |

OTHER PUBLICATIONS

Devenyns, "Optimal Use of Hydrogen Peroxide To Design Low AOX ECF Sequences", 1995 Pulping Conf. Oct. 1995.*

"Peroxide in the Semibleaching of Kraft Pulp", *Papper Och Trä*, No. 11, 1968, pp. 629–638.

"Bleaching Sulphate Pulp with Hydrogen Peroxide", P.K. Christensen; *Pulp and Paper Magazine of Canada*, vol. 73, No. 2 Feb. 1972, pp. 62–66.

"Bleaching of chemical Pulps with Oxygen and Ozone", N. Soteland; *Pulp and Paper Magazine of Canada*, vol. 75, No. 4, Apr. 1974, pp. 91–96.

"Peroxide Beaching of Kraft Softwood", Hassan Loutfi, *Pulp and Paper Canada*, vol. 81, No. 12, Dec. 1980, pp. 145–149.

"Hydrogen Peroxide Bleaching", *1983 Bleach Plant Operations*; pp. 65–71.

(List continued on next page.)

*Primary Examiner*—Steve Alvo
(74) *Attorney, Agent, or Firm*—Luedeka, Neely & Graham, P.C.

(57) ABSTRACT

The invention relates to methods for reducing the amount of halogenated organics produced during a halogen bleaching process for lignocellulosic pulp fibers. According to the disclosed invention, it has been discovered that the use of a chelating agent prior to a non-halogen containing bleaching stage of a pulp bleaching process is effective to increase the brightness of the resulting bleached pulp without the need to increase the amount of halogen compounds required to obtain the same pulp brightness and without adversely affecting the pulp viscosity and yield.

39 Claims, 4 Drawing Sheets

OTHER PUBLICATIONS

"Bleaching with Hydrogen Peroxide in High Density Storage; Pulp Bleaching", R. Owins, W. G. Strunk and Ty. Y. Meng, *Pulp & Paper Canada*, 869 (1985), pp. 79–84.
"Present Possibilities for Hydrogen Peroxide as a Bleaching Agent for Kraft Pulps":, M. G. Delattre, *Appita*, Vo. 28, No. 2, Sep. 1974, pp. 89–98.
Chlorine–Free Bleaching: Ozone and Enzymes to the Rescue?, Martin MacLeod, *Tappi Journal*, Nov. 1991, pp. 203–208.
Singh, "The Bleaching of Pulp", TAPPI Press, Atlanta, GA, 1979, pp. 130–134.
Carmichael et al., "Short–Sequence Bleaching with Hydrogen , Peroxide", Tappi J. , Nov. 1986, pp. 90–94.
Robitaille, "Hydrogen Peroxide: A Versatile Bleaching Agent", Pulp & Paper Canada, Dec. 1988, pp. 167–170.
Sergeyev, et al., "Integration of D and EDTA Stages during Hardwood and Softwood Pulp Bleaching", The Siberian Pulp and Paper Research Institute, Bratsk, Russia.

* cited by examiner

MINIMIZING CHLORINATED ORGANICS IN PULP BLEACHING PROCESSES

This application is a continuation of application Ser. No. 09/149,313, filed Sep. 8, 1998, now abandoned; which is in turn a continuation of application Ser. No. 08/617,612, filed Mar. 19, 1996, now abandoned.

FIELD OF THE INVENTION

The present invention relates to an improved process for halogen bleaching of pulp to obtain a significant increase in the brightness of the pulp without the need to increase the amount of halogen compounds used during the pulp bleaching process and without significant loss of pulp properties such as viscosity and yield.

BACKGROUND OF THE INVENTION

The process of bleaching pulp for use in paper applications may be performed with halogen containing or non-halogen containing bleaching agents. Due to public perception and environmental concerns over chlorinated organics and dioxins, it has become necessary to reduce the use of halogen containing bleaching agents. An attempt to reduce the use of halogen compounds during the bleaching process by use of peroxide and/or non-halogen containing oxygen compounds often results in a detrimental effect on the characteristics of the pulp including decreased brightness, viscosity and yield.

One reason for the decrease in brightness of the pulp is the presence of metal ions in the bleached pulp. In an attempt to remove metals from the pulp, chelating agents have been added during the peroxide bleaching stage (P) of a non-halogen bleaching process and/or subsequent to the last alkaline stage since many of the metals are introduced into the pulp with the water used in the extraction and wash stages of the bleaching process. None of these prior uses of chelating agents has been found to be effective for decreasing the amount of halogenated compounds required to bleach the pulp in a halogen and non-halogen bleaching process while maintaining the target brightness, viscosity and yield characteristics of the pulp.

It is an object of the present invention to provide a process which reduces the amount of chlorinated organics in paper products and effluent from a paper bleaching process.

It is another object of the invention to provide a halogen bleaching process wherein the efficiency of the bleaching process is improved without adversely affecting the pulp viscosity or yield.

A further object of the invention is to provide a method for reducing the use of chlorinated compounds in a pulp bleaching process while obtaining a target brightness for the bleached pulp.

SUMMARY OF THE INVENTION

Having regard to the above and other objects, the present invention provides a method for bleaching a pulp containing lignocellulosic fibers with one or more halogen containing compounds, preferably chlorine and/or chlorine dioxide, whereby the amount of adsorbable organic halide content of the bleached pulp is significantly reduced. The method comprises contacting the pulp during one or more chlorine bleaching stages with an amount of chelating agent sufficient to increase the brightness of the pulp over the brightness of pulp which has been treated with a chelating agent after a final washing or extraction stage of the bleaching process, whereby an adsorbable organic halide content of the bleached pulp is significantly reduced.

It has been discovered, quite surprisingly, that contacting the pulp with one or more chelating agents during at least one of the halogen bleaching, wash or extraction sequences provides a pulp having superior brightness as compared to pulp bleached with the same amount of halogen compounds in the absence of the chelating agent. Furthermore, an increase in the pulp viscosity may be obtained by adding one or more oxygen stabilizers during a subsequent non-chlorine bleaching stage. Accordingly, the foregoing benefits may be obtained without significantly increasing the amount of organic halide compounds in the pulp or effluent from the bleaching process. These results are truly remarkable since they do not require substantial changes in the bleaching process and thus may be implemented without significantly increasing the complexity or operating cost of the bleaching process and without the need for significant capital expenditures.

In another aspect the invention provides a process for bleaching a pulp containing lignocellulosic fibers. The process comprises maintaining the pulp at a consistency in the range of from about 0.5% to about 40% and maintaining the pH in the range of from about 1 to about 9. The pulp is then bleached with a chlorine compound in a bleaching stage. During the bleaching or before a washing stage, the pulp is contacted with from about 0.01 wt. % to about 1 wt. % chelating agent. The amount of chelating agent used is based on the dry weight of pulp. This process has been found to significantly reduce the amount of adsorbable organic halide in the bleached pulp.

In a preferred embodiment, the invention provides a process for bleaching a pulp containing lignocellulosic fibers with chlorine and non-chlorine containing bleaching agents, wherein the pulp has a consistency in the range of from about 0.5% to about 40% and has a pH in the range of from about 1 to about 9. The process comprises treating the pulp with chlorine dioxide in a first chlorination stage. Subsequent to the first chlorination stage, the pulp is contacted with a first amount of metal chelating agent, wherein the amount of chelating agent is sufficient to reduce an organic halide content of the fibers and wherein the temperature of the pulp during the contacting is within the range of from about 35° to about 110° C. Next the chlorine bleached pulp is bleached with a chlorine-free bleaching agent after a subsequent extraction stage resulting in bleached pulp having a low level of chlorinated organic compounds.

DETAILED DESCRIPTION OF THE INVENTION

Figure 1:
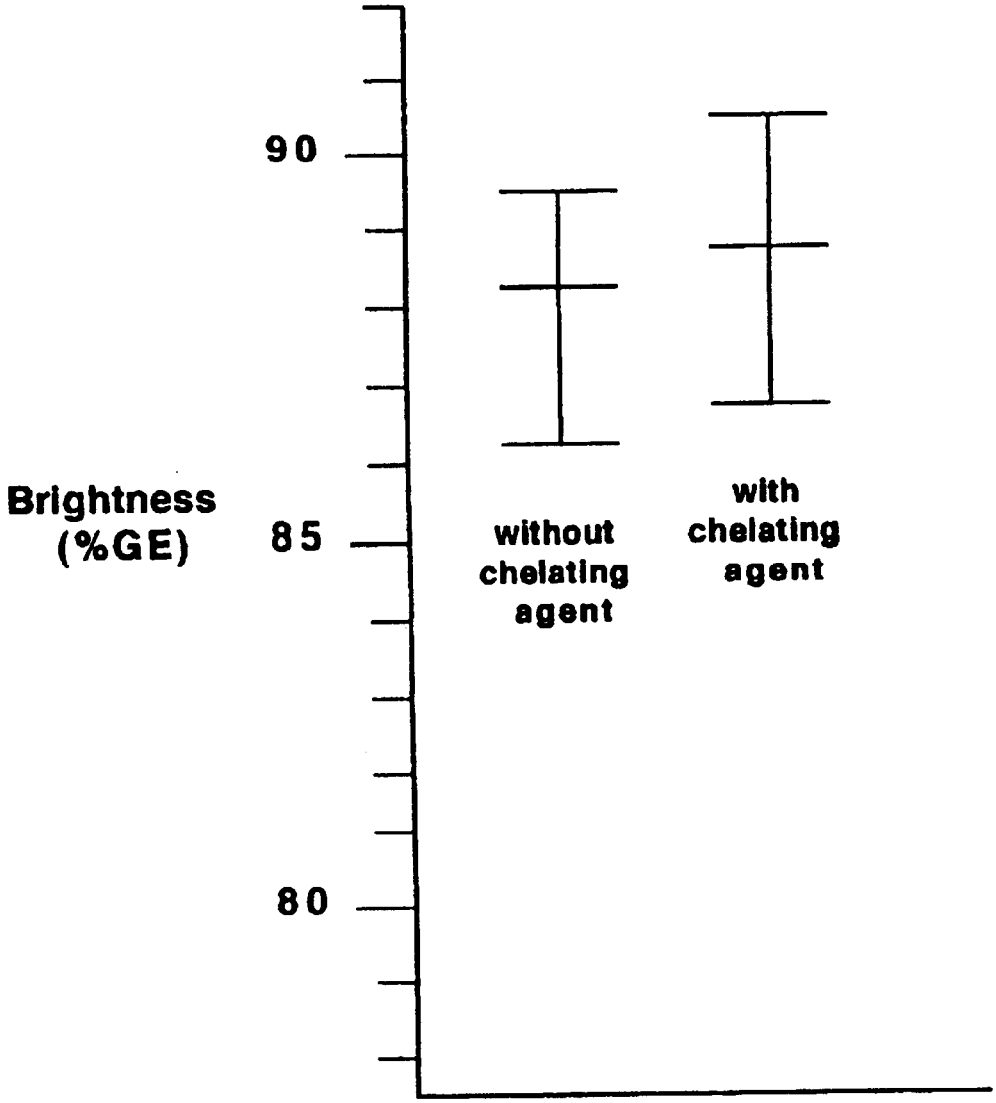
FIG. 1 illustrates the effect of the addition of a chelating agent during a halogen bleaching stage on the brightness of a bleached softwood pulp.

In the practice of the present invention a chelating agent is added to one or more stages of a halogen and non-halogen bleaching process for pulp, preferably during one or more halogen bleaching, washing or extraction stages. Each halogen bleaching stage may be either a chlorine bleaching stage (C stage) or a chlorine dioxide bleaching stage (D stage). Each halogen bleaching stage may involve the use of chlorine or chlorine dioxide as well a combination of chlorine or chlorine dioxide as in a $D_c$ stage or a $C_d$ stage. It is particularly preferred to contact the pulp with the chelating agent during or subsequent to each halogen bleaching stage.

In a multi stage bleaching process there is typically a washing stage and/or an alkaline extraction stage (E) after each halogen bleaching stage. The extraction stage may be conducted with or without the use of a non-halogen containing oxidizing agent such as ozone or peroxide. The sequential addition of the chelating agent is more preferred than the simultaneous addition of the chelating agent with chlorine dioxide or chlorine or in an admixture of chlorine dioxide and chlorine however, the invention is not limited to sequential addition of the chelating agent.

Chelating agents suitable for use with the process of the invention may be selected from the primary, secondary or tertiary nitrogen containing compounds such as the amino- and aminopolycarboxylic acids and the alkaline metal salts thereof, the phosphonates and the hydroxy alkylidene diphosphonates, the aminopolyphosphonic acids and the alkaline metal salts thereof, the polyhydroxy- and hydroxypolycarboxylic acids and the alkaline metal salts thereof and the acrylic acid polymers. Accordingly, the chelating agents which may be used include orthophosphonic acid, sodium or potassium orthophosphoric acid, sodium or potassium orthophosphates, sodium or potassium pyrophosphates, sodium polyphosphates, cyclohexanediaminetetraacetic acid, nitrilotriacetic acid (NTA), ethylenediaminetetra (methylenephosphonic) acid, nitrilotri (methylenephosphonic) acid, ethylenediaminetetraacetic acid (EDTA), diethylenetriaminepentaacetic acid (DTPA), citric acid, tartaric acid, gluconic acid, hydroxyethylenediaminetriacetic acid, diethylenetriaminepenta (methylenephosphonic) acid (DTPMA), tripolyphosphate, bis-phosphonylmethylphosphinic acid, and the alkaline metal salts thereof. Of the foregoing, compounds such as EDTA, DTPA, and NTA, as well as the other compounds disclosed hereinabove, and those of similar structure, allow treatment of the pulp with chlorine containing compounds while producing a pulp and effluent with lowered concentrations of chlorinated organics. The amount of chelating agent added to the pulp during the one or more halogen bleaching stages generally ranges from about 0.01 wt. % to about 1 wt. % based on the dry weight of the pulp, preferably from about 0.05 wt. % to about 0.5 wt. % and most preferably from about 0.05wt. % to about 0.2 wt. %.

The method comprises the steps of maintaining the consistency of the pulp in the solution at a range of from about 0.5% to about 40% by weight, preferably in the range of from about 3 to about 15% by weight, and adding a chelating agent to the solution of pulp during one or more halogen bleaching, wash or extraction stages. The concentration of the chelating agent is in the range of from about 0.01 wt. % to about 1 wt. %, based on the dry weight of pulp in the brown stock, more preferably, in the range of from about 0.03 wt. % to about 0.5 wt. % based on the dry weight of pulp in the brown stock. It has been found that there is a remarkable increase in viscosity, yield, and brightness of the pulp when compared to processes which do not use the chelating agent during one or more halogen bleaching, wash or extraction stages.

In a preferred embodiment of the invention, the chelating agent is added to the bleaching tower exit dilution zone subsequent to chlorination or to the wash vat after the bleaching tower. During the chelating agent addition, the solution of pulp is preferably maintained at a pH in the range of from about 1 to about 9, more preferably from about 1 to about 6, depending on the chelating agent used, and at a temperature in the range of from about 15° C. to about 95° C., more preferably from about 35° C. to about 85° C. The bleached pulp is contacted with the chelating agent for a period of time in the range of from about 1 minute to about 120 minutes, and more preferably from about 6 minutes to about 60 minutes.

In another preferred embodiment of the invention, the stage of the bleaching process where the chelating agent is added in is a chlorine dioxide stage and the pH is maintained in the range of from about 1 to about 9, more preferably from about 1 to about 6, at a temperature in the range of from about 50° C. to about 95° C., more preferably from about 60° C. to about 90° C., for a period of time in the range of from about 5 minutes to about 20 hours, more preferably for a period of time from about 1 hour to about 3 hours.

When the stage of the bleaching process wherein the chelating agent is added is an extraction stage, the pH is maintained in a range of from about 7 to about 14, more preferably from about 10 to about 14, and the temperature is maintained in the range of from about 50° C. to about 120° C., more preferably from about 60° C. to about 95° C. Preferably, the chelating agent is maintained in the extraction stage for a period of time in the range of from about 5 minutes to about 20 hours, more preferably from about 30 minutes to about 3 hours.

When the bleaching stage is an extraction stage a viscosity protection agent may be added to the solution at a concentration in the range of from about 0.01 wt. % to about 1 wt. % based on dry weight of the pulp in order to increase the viscosity of the bleached pulp. More preferably, the viscosity protection agent is added at a concentration in the range of from 0.03 wt. % to about 0.8 wt. %. The viscosity protection agent may be selected from a magnesium salt of an inorganic acid and magnesium acetate. More preferably, the viscosity protector is magnesium sulfate.

Subsequent to the halogen bleaching step and the contacting with the chelating agent, the pulp is typically further treated by use of an extraction stage with or without the use of a non-chlorine containing oxygen compound. The non-chlorine containing oxygen compounds include hydrogen peroxide, ozone, peracetic acid and the like.

According to one aspect of the invention, there is an increase in the viscosity, yield and brightness of the pulp when compared to the same bleaching process without the use of the chelating agent. Also there is an increase in the dirt removal from the solution of the pulp when compared to traditional bleaching processes.

In addition to adding the chelating agent to one or more of the foregoing halogen bleaching stage, the addition of a chelating agent to a peroxide stage (P) may also boost the pulp brightness in that stage particularly when the peroxide bleaching stage follows a chlorine dioxide stage. Typically, the peroxide bleaching stage is conducted in the presence of a stabilizer such as sodium silicate in order to permit effective bleaching while minimizing degradation of the pulp.

In order to provide a further understanding, the following non-limiting examples are given primarily to illustrate certain more specific aspects of the invention.

EXAMPLE I

Different chelating agents were added in the chlorine dioxide stage of a $D_0E_{0+p}DP$ sequence (wherein $D_0$ is read as "$D_{zero}$" and is referred to as the initial chlorination stage) after addition of the chlorine dioxide in the D stage to the pulp. Sample #1 is a control without the addition of a chelating agent. The brown stock was a softwood pulp with a Kappa of 30.7 and a viscosity of 31.7 cp. The $D_0$ stage had a 0.2 chlorination factor at 50° C. at a 40 minute residency with a 10 wt. % consistency. The $E_{0+p}$ stage was conducted for 1 hour at 85° C. and contained 2.7 wt. % sodium hydroxide and 0.6 wt. % peroxide solution and had a 10 wt. % consistency. The pulp was treated in the D stage at 90° C. for 1.5 hours at 10 wt. % consistency with 0.4 wt. % chlorine dioxide and 0.16 wt. % sodium hydroxide. In the P stage, the pulp was treated with 1.5 wt. % peroxide, 1 wt. % sodium hydroxide, 0.05 wt. % magnesium sulfate, at 10 wt. % consistency and 90° C. for 3 hours. Table 1 illustrates the brightness and viscosity of the pulps after the sequential addition of the chelating agent in the D stage.

TABLE 1

| Sample # | Chelating Agent | Brightness (% GE) | Viscosity (cP) |
|---|---|---|---|
| 1 | None (control | 86.3 | 15.7 |
| 2 | 0.4 wt. % EDTA[1] | 88.7 | 19.5 |
| 3 | 0.2 wt. % DTPA[2] | 88.9 | 15.1 |
| 4 | 0.5 wt. % STP[3] | 87.1 | 11.6 |
| 5 | 0.3 wt. % DTPMA[4] | 88.3 | 13.8 |
| 6 | 0.3 wt. % DMA[5] | 87.5 | 15.1 |
| 7 | 0.5 wt. % TAR[6] | 87.5 | 11.3 |

[1]EDTA = disodium salt of ethylenediaminetetraacetic acid
[2]DTPA = pentasodium salt of diethylenetriaminepentaacetic acid
[3]STP = sodium triphosphate
[4]DTPMA = diethylenetriaminepenta(methylenephosphonic) acid
[5]DMA = 2-hydroxy-4,6-dimethoxy acetophenone
[6]TAR = sodium tartrate In each of Samples 2–7, the chelating agent was added 30 minutes after the addition of $ClO_2$ in the D stage. As illustrated, the addition of the chelating agents resulted in an increase in the efficiency of the subsequent peroxide stage bleaching. Approximately 1 to 2.5 units higher brightness were obtained as compared to the control sample without the use of the chelating agent. With EDTA (Samples 2), the final pulp viscosity was 3.8 points higher than the control.

EXAMPLE II

In this series of samples, the chelating agent was added simultaneously with the addition of chlorine dioxide in the (D) stage of the $D_0E_{0+p}DP$ bleaching process. The conditions and amount of reagents used in the bleaching process were the same as in Example I. The results are illustrated in Table 2.

TABLE 2

| Sample # | Chelating Agent | Brightness (% GE) | Viscosity (cP) |
|---|---|---|---|
| 8 | None (control) | 87.3 | 15.3 |
| 9 | 0.4 wt. % EDTA[1] | 87.5 | 19.5 |
| 10 | 0.2 wt. % DTPA[2] | 85.0 | 17.2 |
| 11 | 0.5 wt. % STP[3] | 86.8 | 12.8 |
| 12 | 0.3 wt. % DTPMA[4] | 86.5 | 13.6 |

TABLE 2-continued

| Sample # | Chelating Agent | Brightness (% GE) | Viscosity (cP) |
|---|---|---|---|
| 13 | 0.3 wt. % DMA[5] | 85.0 | 14.5 |
| 14 | 0.5 wt. % TAR[6] | 87.2 | 14.6 |

[1]EDTA = disodium salt of ethylenediaminetetraacetic acid
[2]DTPA = pentasodium salt of diethylenetriaminepentaacetic acid
[3]STP = sodium triphosphate
[4]DTPMA = diethylenetriaminepenta(methylenephosphonic) acid
[5]DMA = 2-hydroxy-4,6-dimethoxy acetophenone
[6]TAR = sodium tartrate The simultaneous addition of the chelating agents with chlorine dioxide produced relatively small changes in brightness but did show a large improvement in viscosity for EDTA and DTPA (Samples 9 and 10).

EXAMPLE III

Chelating agents were added at the end of the chlorine dioxide (D) bleaching stage in the $D_0E_{0+p}DP$ bleaching process to simulate addition in the bleaching tower dilution zone or washer vat dilution zone. The conditions and reagents were otherwise the same as described in Example I except that the chelating agent was dissolved by mixing the chelating agent for 1 minute in water at 60° C. and a pH 4. The results are given in Table 3.

TABLE 3

| Sample # | Chelating Agent | Brightness (% GE) | Viscosity (cP) |
|---|---|---|---|
| 15 | None (control) | 87.3 | 15.3 |
| 16 | 0.4 wt. % EDTA[1] | 88.9 | 17.9 |
| 17 | 0.2 wt. % DTPA[2] | 89.4 | 13.8 |
| 18 | 0.5 wt. % STP[3] | 89.8 | 14.6 |
| 19 | 0.3 wt. % DTPMA[4] | 88.3 | 16.0 |

[1]EDTA = disodium salt of ethylenediaminetetraacetic acid
[2]DTPA = pentasodium salt of diethylenetriaminepentaacetic acid
[3]STP = sodium triphosphate
[4]DTPMA = diethylenetriaminepenta(methylenephosphonic) acid The addition of the chemical additives at the end of the D stage improved the brightness by greater than about 1% with all of the chelating agents tested. In addition, the viscosity remained at a good level.

EXAMPLE IV

In this series of examples, a disodium salt of EDTA was used as the chelating agent. The chelating agent was added at 0.4 wt. % at different times to the D stage of the $D_0E_{0+p}DP$ bleaching sequence. The pulp was subjected to an acid wash between the D stage and the P stage. Otherwise, the conditions and reagents were the same as described in Example III. The control (Sample 20) was subjected to an acid wash only. In Sample 21 the chelating agent was added after 5 minutes of an acid wash, in Sample 22 the chelating agent was added simultaneously with the acid wash, and in Sample 23 the chelating agent was added at the end of the acid wash. The results are shown in Table 4.

TABLE 4

| Sample # | Addition of CA | Brightness (% GE) | Viscosity (cP) |
|---|---|---|---|
| 20 | None (control) | 86.8 | 9.8 |
| 21 | After 5 min. | 89.8 | 16.8 |
| 22 | To acidic wash | 88.7 | 13.4 |
| 23 | End of acidic wash | 89.5 | 13.3 |

Each of the samples using the chelating agent had a 2 to 3 point greater brightness than the control sample (Sample 20) and a 4 to 7 point higher viscosity.

EXAMPLE V

A chelating agent, 0.4 wt. % disodium salt of EDTA, was added to a halogen and peroxide bleaching sequence at various stages of the sequence. The results are given in Table 5. In the Table, the T stage is used to indicate the stage wherein the chelating agent is added. In Sample 25 the chelating agent was added in the washing vat after the initial chlorination stage and before the extraction stage. In Sample 26 the chelating agent was added after the chlorination stage and before the extraction stage without washing after the chlorination stage. In Sample 27 the chelating agent was added after the extraction stage but before the D stage. In Sample 28 the chelating agent was added in the D stage after chlorine dioxide was added. In Sample 29 the chelating agent was added in the D stage washer vat. In Sample 30 the chelating agent was added after the D stage but before the P stage. The $E_{0+p}$ stage was conducted with an oxygen pressure ranging from 45 to 0 psig within 1 hour and the D stage was conducted at 70° C. and the T stages after the $E_{0+p}$ stages were conducted for 1 hour at a pH of 4 and 90° C., with 10 wt. % consistency. Otherwise the conditions and reagents were the same as Example I.

TABLE 5

| Sample # | Bleaching Sequence | Chelating Agent Stage | Brightness (% GE) | Viscosity (cP) |
|---|---|---|---|---|
| 24 | $D_oE_{o+p}DP$ | None | 86.3 | 15.7 |
| 25 | $D_oTE_{o+p}DP$ | prior to E | 87.3 | 12.6 |
| 26 | $(D_oT)E_{o+p}DP$ | during $D_o$ | 87.3 | 11.4 |
| 27 | $D_oE_{o+p}TDP$ | prior to D | 88.9 | 12.3 |
| 28 | $D_oE_{o+p}(DT)P$ | in D after 5 min. | 88.8 | 18.6 |
| 29 | $D_oE_{o+p}(DT)P$ | add to washer vat | 86.7 | 15.6 |
| 30 | $D_oE_{o+p}DTP$ | prior to P | 88.9 | 17.9 |

The results show that about 1 to 2.5 points of brightness were gained by adding the chelating agent in all stages of the bleaching process. The results also show that generally it was better to insert a T stage (i.e., add chelating agent) in a later stage of the bleaching process to improve both brightness and viscosity (Samples 28, 29 and 30).

EXAMPLE VI

In this example, chelating agents were added in the extraction stage (E) and/or in the chlorine dioxide bleaching stage (D) with the observation that different effects on the pulp were obtained. Chelating agents were added to $D_0E_pP$, $D_0E_pD$, and $D_0E_pDP$ sequences. The brown stock was a softwood pulp with a Kappa of 30.7 and a viscosity of 31.7 cp. The $D_0$ stage had a 0.2 chlorination factor at 50° C. at a 40 minute residency with a 10 wt. % consistency. The $E_p$ stage was conducted for 1 hour at 90° C. and contained 2.7 wt. % sodium hydroxide and 1.0 wt. % peroxide solution and had a 10 wt. % consistency. The %GE brightness of the $E_p$ pulp for Samples 31–35 was 58.3, for Samples 36–40 was 66.1 and for Samples 41–45 was 62.5. The pulp was treated in the D stage at 70° C. for 1.5 hours at 10 wt. % consistency with 0.4 wt. % chlorine dioxide and 0.16 wt. % sodium hydroxide. In the P stage, the pulp was treated with 2.0 wt. % peroxide, 1.3 wt. % sodium hydroxide, 0.05 wt. % magnesium sulfate, at 10 wt. % consistency and 90° C. for 3 hours. In Samples 31–33 no chelating agents were added to the bleaching processes. In Samples 34 and 35, a disodium salt of EDTA was added as the chelating agent after 30 minutes in the D stage. Samples 36–40 were conducted in a manner similar to Samples 31–35, however, 0.9 wt. % triethanolamine (TEA) was also added in the $E_p$ stage. In Samples 41–45, 1.4 wt. % potassium salt of gluconic acid (GA) and 0.4 wt. % magnesium sulfate were added in the $E_p$ stage otherwise, the bleaching stages were conducted in a manner similar to Samples 31–35. The results are given in Table 6.

TABLE 6

| Sample | Bleaching # Sequence | $E_p$ Stage | D Stage | Brightness (% GE) | Viscosity (cP) |
|---|---|---|---|---|---|
| 31 | $D_oE_pP$ | None | None | 70.9 | 23.3 |
| 32 | $D_oE_pD$ | Same as above | Acid wash pH = 4 | 77.2 | 25.2 |
| 33 | $D_oE_pDP$ | Same as above | Acid wash pH = 4 | 83.2 | 16.4 |
| 34 | $D_oE_pD$ | Same as above | Add T after 30 min. | 77.3 | 28.7 |
| 35 | $D_oE_pDP$ | Same as above | Add T after 30 min. | 87.6 | 16.2 |
| 36 | $D_oE_pP$ | 0.9% TEA | None | 73.2 | 25.9 |
| 37 | $D_oE_pD$ | Same as above | Acid wash pH = 4 | 77.2 | 27.2 |
| 38 | $D_oE_pDP$ | Same as above | Acid wash pH = 4 | 83.2 | 16.8 |
| 39 | $D_oE_pD$ | Same as above | Add T after 30 min. | 77.5 | 26.8 |
| 40 | $D_oE_pDP$ | Same as above | Add T after 30 min. | 87.7 | 16.0 |
| 41 | $D_oE_pP$ | 1.4% GA 0.4% $MgSO_4$ | None | 79.1 | 21.3 |
| 42 | $D_oE_pD$ | Same as above | Acid wash pH = 4 | 78.0 | 30.6 |
| 43 | $D_oE_pDP$ | Same as above | Acid wash pH = 4 | 87.1 | 22.2 |
| 44 | $D_oE_pD$ | Same as above | Add T after 30 min. | 79.4 | 28.6 |
| 45 | $D_oE_pDP$ | Same as above | Add T after 30 min. | 87.8 | 12.9 |

For the $D_0E_pP$ sequences without acid wash (Samples 31, 36 and 41) the addition of TEA or GA (Samples 36 and 41) resulted in a large increase in the brightness. In the $D_0E_pD$ sequences with acid wash (Samples 32, 37 and 42) the addition of the TEA (Sample 37) in the extraction ($E_p$) stage improved the $E_p$ stage brightness (as discussed above) but did not improve the brightness of the final D stage pulp over the control (Sample 32). However, the addition of GA (Sample 42) to the same sequence during the extraction stage gave an improvement of the D stage brightness of from 0.8 to 1.9% GE. For the $D_0E_pDP$ bleaching sequences with acid wash in the D stage (Samples 33 and 38) the addition of TEA in the $E_p$ stage (Sample 38) did not significantly improved the final brightness over the control (Sample 33). However, the addition of the GA (Sample 43) improved the brightness about 3.9% GE and viscosity to about 5.4 cP. For the $D_0E_pD$ bleaching sequences with the addition of an EDTA chelating agent during the D stage after 30 minutes (Samples 34, 39 and 44), the addition of TEA (Sample 39) did not significantly improve the brightness of the D stage pulp over the control (Sample 34), but the addition of the GA (Sample 44) showed a significant improvement in brightness over Samples 39 and 34. For the $D_0E_pDP$ bleaching sequences with the addition of an EDTA chelating agent during the D stage (Samples 35, 40 and 45), neither the addition of TEA (Sample 40) nor the addition of the GA (Sample 45) showed a significant improvement in brightness over the control (Sample 35).

What is illustrated by Example VI is that adding a chelating agent during the D stage of a $D_0E_pDP$ bleaching process has a significant advantage over the same bleaching sequence without the addition of a chelating agent but with acid washing treatment (Compare Samples 33 and 35). Adding TEA in the $E_p$ stage gave similar results (Compare Samples 38 and 40). Using GA in an extraction stage with $MgSO_4$ results in a similar brightness gain of also using a chelating agent in the D stage of a $D_0E_pDP$ bleaching process but has the added benefit of increasing the viscosity of the pulp.

EXAMPLE VII

This example illustrates the application of the present invention on hardwood pulp. Southern hardwood brown stock with a Kappa of 14.6 and a viscosity of 22.5 cP was treated with a chelating agent (CA), disodium salt of EDTA in the $D_0$ or D stage of a $D_0E_{0+p}DP$ bleaching sequence with a chlorination factor of 0.2 in the Do stage at 60° C. for 35 minutes with a 3.5 wt. % consistency. The $E_{0+p}$ stage used 1.5 wt. % sodium hydroxide, 0.6 wt. % peroxide with an oxygen pressure ranging from 45 psig to 0 psig over a 1 hour period at a temperature of 85° C. The pulp was bleached in the D stage at 70° C. for 1.5 hours and had a 0.4 chlorination factor and a 10 wt. % consistency pulp. The h stage also had a 0.4 chlorination factor (as hypochlorite) with a 10 wt. % consistency pulp at 70° C. for 1.5 hours. The P stage contained 1.5 wt. % sodium hydroxide, 0.05% magnesium sulfate, and the pulp at a 10 wt. % consistency was treated at 90° C. for 3 hours. The results of the bleaching sequences are given in Table 7.

TABLE 7

| Sample # | Bleaching Sequence | $D_o$ Stage | D or h Stage | Brightness (% GE) | Viscosity (cP) |
|---|---|---|---|---|---|
| 46 | $D_oE_{o+p}DP$ | C.F. = 0.2 No CA | 0.3% D | 79.5 | 9.2 |
| 47 | $D_oE_{o+p}DP$ | C.F. = 0.2 | 0.3% D 0.5% CA | 89.1 | 13.1 |
| 48 | $D_oE_{o+p}(DP)$ | C.F. = 0.2 0.5% CA | 0.3% D | 86.3 | 15.5 |
| 49 | $D_oE_{o+p}hP$ | C.F. = 0.2 0.5% CA | 0.3% h | 83.7 | 13.0 |

The results show that the brightness of a hardwood pulp may be increased as much as 4 to 10 points through the use of a chelating agent in the first or third chlorine dioxide bleaching stages (Samples 47–49).

EXAMPLE VIII

The following samples were run to determine the effect on brightness and viscosity of the addition of the chelating agent 0, 1, 3 and 60 minutes after adding the chlorine dioxide to the chlorine dioxide stage. The samples were conducted with Northern softwood pulp brown stock having a kappa number of 20. The bleaching sequence was $D/CE_pD_qP$. The D/C stage conditions were 0.6 wt. % $ClO_2$, 50° C., 3.5 wt. % consistency and 30 minutes contact time. The $E_p$ stage conditions were 2.0 wt. % NaOH, 0.6 wt. % hydrogen peroxide, 70° C., 40 minutes contact time and 10 wt. % consistency. The $D_q$ stage conditions were 0.6 wt. % $ClO_2$, 0.25 wt. % NaOH, 80° C., 2 hours contact time and 10 wt. % consistency. The chelating agent added in the $D_q$ stage after the time indicated was 0.2 wt. % EDTA. The P stage conditions were 2 wt. % peroxide, 1.5 wt. % NaOH, 90° C., 3 hours and 10 wt. % consistency. Results of the foregoing runs are contained in Table 8.

TABLE 8

| Sample # | Bleaching Sequence | Chelating Agent Addition (min.) | Brightness (% GE) | Viscosity (cP) |
|---|---|---|---|---|
| 50 | $D/CE_pD_qP$ | none | 71.9 | 14.3 |
| 51 | $D/CE_pD_qP$ | after 0 min. | 80.0 | 14.2 |
| 52 | $D/CE_pD_qP$ | after 1 min. | 83.5 | 14.1 |
| 53 | $D/CE_pD_qP$ | after 3 min. | 83.7 | 15.2 |
| 54 | $D/CE_pD_qP$ | after 60 min. | 83.8 | 12.1 |

Samples 51–54 illustrate the substantial increase in brightness achieved by the use of a chelating agent in the chlorine dioxide stage as compared to the control (Sample 50) wherein no chelating agent was used. These runs also show that adding the chelating agent 1 minute or more after adding the chlorine dioxide has a significant effect on the pulp brightness.

EXAMPLE IX

A series of pulp bleaching sequences were conducted to determine the overall advantage of the use of a chelating agent according to the present invention. The bleaching sequence was $D \rightarrow C_DE_{0+p}DP$ for a softwood pulp. The conditions in the $D \rightarrow C_D$ stage were: chlorination factor of 0.10 to 0.22; chlorine dioxide substitution at 0 to 100%; and pH of 1.4 to 2.6. The conditions in the D stage were: chlorine charge of 0.3 to 1.2 wt. %; and pH of 1.8 to 3.9. Conditions in the P stage were: peroxide charge of 0.4 to 1.4 wt. %. Two sets of these reactions were run. An initial set was run without a chelating agent prior to the P stage and one was run with a chelating agent prior to the P stage. The chelating agent was disodium salt of EDTA at 0.5 wt. %. The results are illustrated in FIGS. 1–4.

Figure 2:
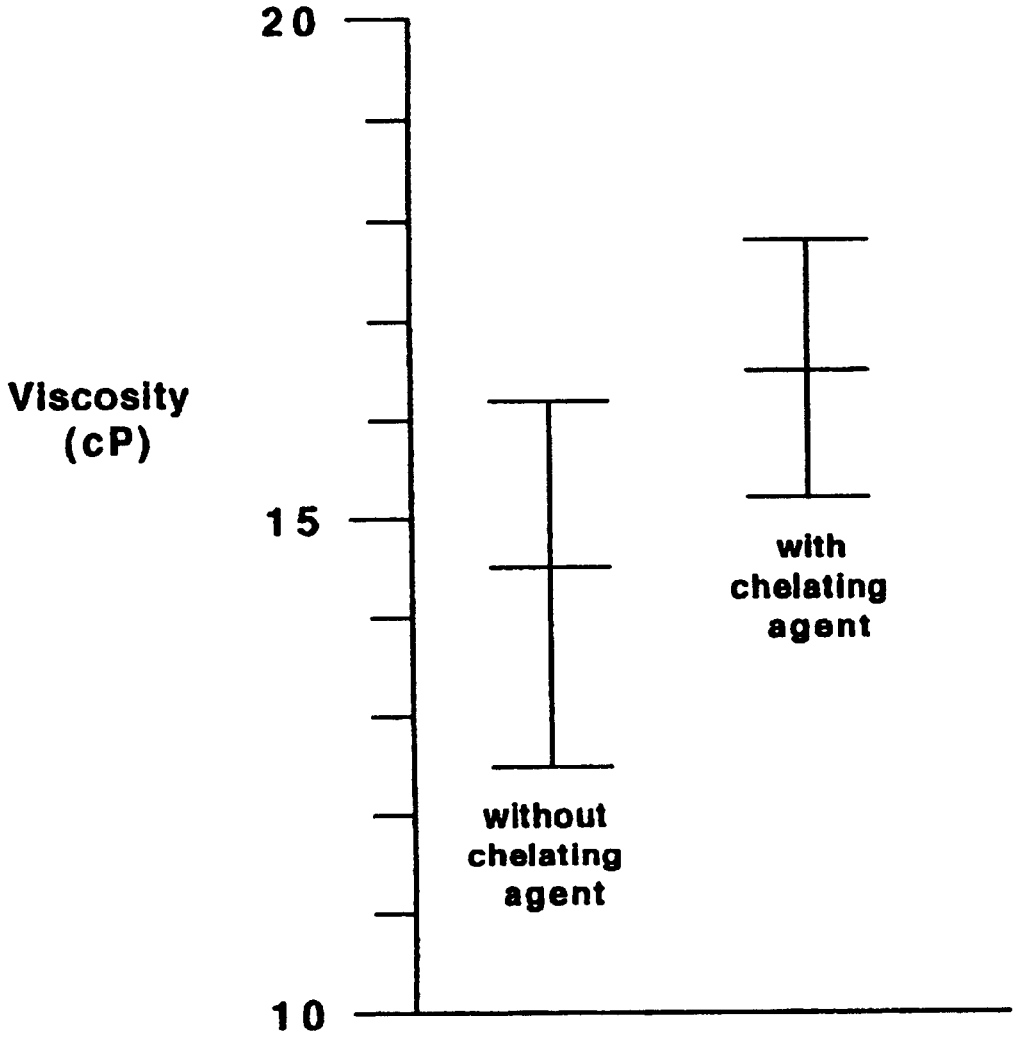
FIG. 2 illustrates the effect of the addition of a chelating agent during a halogen bleaching stage on the viscosity in of a bleached softwood pulp.
Figure 3:
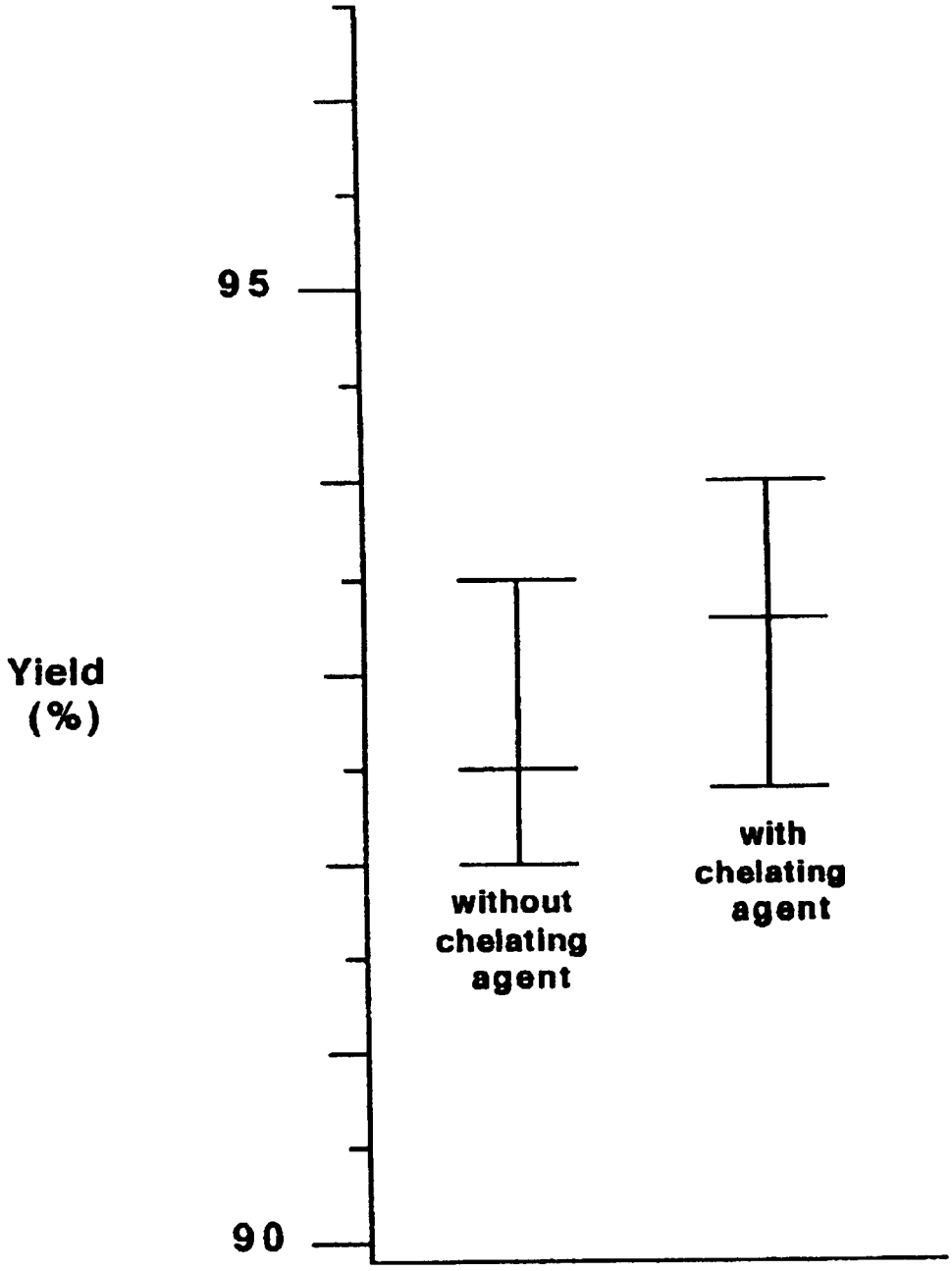
FIG. 3 illustrates the effect of the addition of a chelating agent during a halogen bleaching stage on the yield of a bleached softwood pulp.
Figure 4:
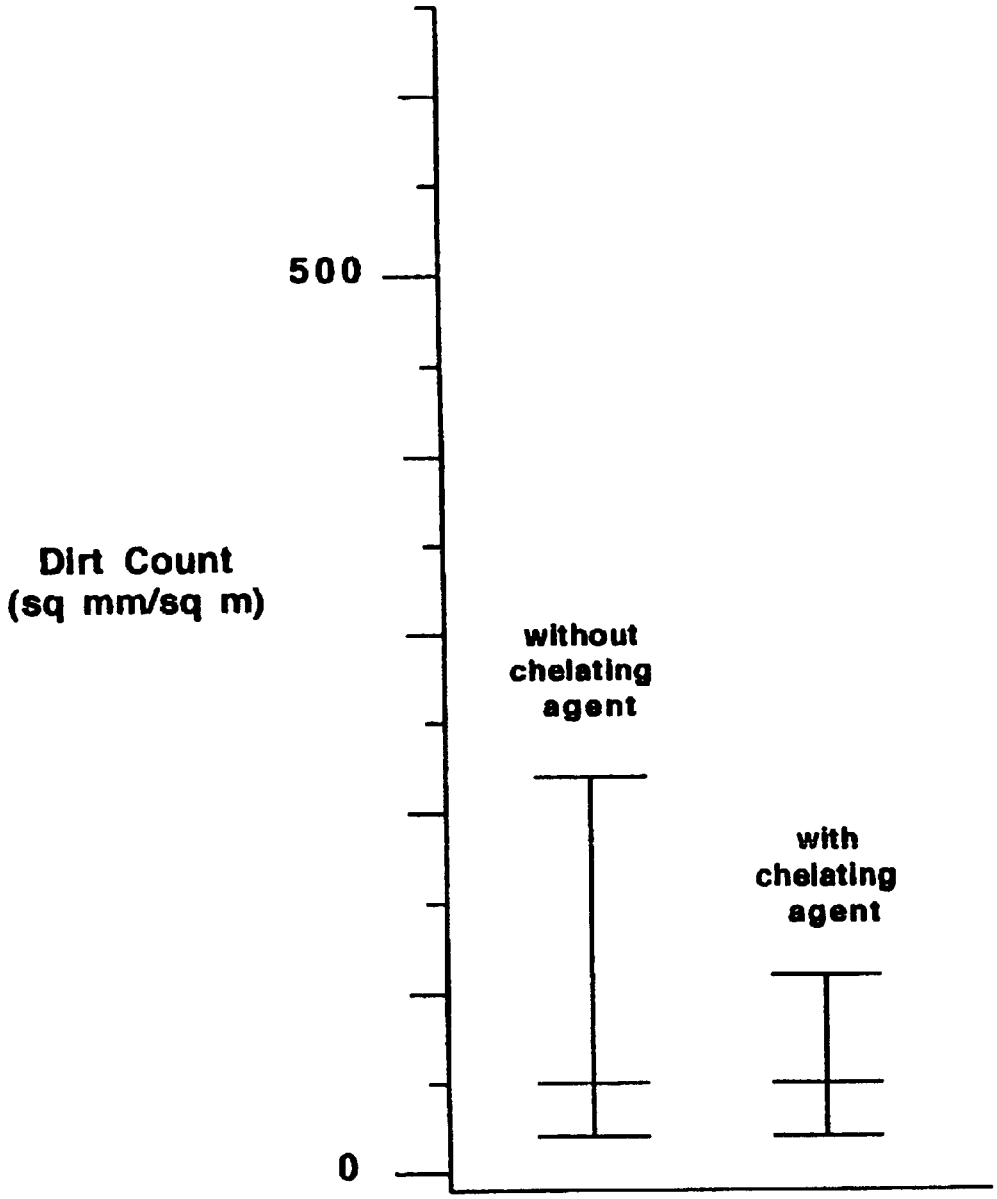
FIG. 4 illustrates the effect of the addition of a chelating agent during a halogen bleaching stage on the dirt content of a bleached softwood pulp.

FIG. 1 illustrates the effect of the addition of the chelating agent on the brightness in percent GE of the pulp. The use of the chelating agent produced a significantly brighter pulp than a pulp bleached without the chelating agent. FIG. 2 illustrates the effect of adding the chelating agent on the viscosity of the pulp. The viscosity of the pulp was approximately 3 cP greater when the chelating agent was used during the bleaching sequence. FIG. 3 illustrates the effect on yield when the chelating agent is added. The yield was significantly greater upon addition of the chelating agent as opposed to when no chelating agent was used. FIG. 4 illustrates the effect of adding the chelating agent on the resulting dirt count. The dirt count was significantly reduced when the chelating agent was used during the bleaching process.

EXAMPLE X

In this series of samples, an extended delignified pulp rather than a conventional kraft pulp was used to illustrate the effect of the addition of chelating agents on a bleaching sequence with and without a peroxide bleaching stage. The pulp was a delignified southern softwood pulp with a Kappa number of 22.1 and a pulp viscosity of 31.7 cP. The $D_0$ stage was conducted for 40 to 45 minutes at 50° C. and 10 wt. % pulp consistency. The $E_{0+p}$ stage was conducted with 1.8–2.5 wt. % sodium hydroxide, 0.4 to 0.6 wt. % peroxide, 10 wt. % pulp consistency, and an oxygen pressure ranging from 45 to 0 psig over a 1 hour period at 70° C. The D stage was conducted at 70° C. with 1 wt. % chlorine dioxide and 0.4 wt. % sodium hydroxide at 10 wt. % pulp consistency. The P stage was conducted at 90° C. and 10 wt. % pulp consistency.

Samples 55, 56 and 57 illustrated that there was a slight gain in pulp brightness and viscosity by using magnesium sulfate and/or sodium silicate (Samples 56 and 57) as compared to the control (Sample 55) when no chelating agents were used. The use of EDTA in the D stage of the bleaching process with magnesium sulfate and/or sodium silicate (Samples 58 and 59) provided a significant increase in brightness and viscosity as compared to the control (Sample 55). Samples 60 illustrated a conventional $D_0E_{0+p}D$ bleaching process using a chlorination factor of 0.22 as compared to the chlorination factor of 0.13 for samples 55–59 and in Sample 61 a P stage is used before the D stage. While the brightness characteristics of the pulp are similar to the pulp bleached with a chelating agent and a lower chlorination factor. (Sample 59), the viscosity of the pulp in Sample 61 is much lower than in Samples 58 and 59. Accordingly, the benefits of the use of a chelating agent on the brightness of the pulp using a lower chlorination factor are illustrated in Table 9.

TABLE 9

| Sample # | Bleaching Sequence | D Stage | P Stage | Brightness (% GE) | Viscosity (cP) |
|---|---|---|---|---|---|
| 55 | $D_oE_{o+p}DP$ | 1.0% D 70° C. 2.5 hrs | 1.3% P 1.5% NaOH 90° C., 3 hrs | 86.4 | 14.1 |
| 56 | $D_oE_{o+p}DP$ | 1.0 % D 70° C. 2.5 hrs | 1.3% P 1.5% NaOH 90° C., 3 hrs 0.05% $MgSO_4$ | 87.2 | 16.9 |
| 57 | $D_oE_{o+p}DP$ | 1.0% D 70° C. 2.5 hrs | 1.3% P 1.5% NaOH 90° C., 3 hrs 0.05% $MgSO_4$ 1.0% silicate | 88.6 | 16.8 |
| 58 | $D_oE_{o+p}DP$ | 1.0% D 70° C. 2.5 hrs 0.5% CA after 1.5 hr | 1.3% P 1.5% NaOH 90° C., 3 hrs 0.05% $MgSO_4$ | 89.4 | 16.9 |
| 59 | $D_oE_{o+p}DP$ | 1.0% D 70° C. 2.5 hrs 0.5% CA after 1.5 hr | 1.3% P 1.5% NaOH 90° C., 3 hrs 0.05% $MgSO_4$ 1.0% silicate | 88.7 | 24.1 |
| 60 | $D_oE_{o+p}D$ | 1.0% D 0.4% NaOH | No | 87.7 | 18.5 |
| 61 | $D_oE_{o+p}PD$ | 1.0% D 0.4% NaOH | 0.6% P 1.0% NaOH 80° C. | 88.7 | 11.6 |

EXAMPLE XI

In this series of samples, a Kappa 30 kraft pulp was treated with a low chlorination factor (C.F.) (0.08 C.F. in Sample 62 and 0.12 C.F. in Samples 63–72). In all of the samples, 0.5 wt. % EDTA was added in the initial chlorination stage ($D_0$) at 50° C. and in the chlorine dioxide stage (D) at 70° C. In Sample 72, 0.3 wt. % disodium salt of EDTA was also added in the P stage. The percent chlorine dioxide in the D stage varied from 0.8 wt. % in Sample 63 to 1.0 wt. % in Samples 62 and 64–72. During the P stage of Samples 64–72, 0.05 wt. % $MgSO_4$ was added and 1 wt. % sodium silicate was added in the P stage of Samples 71 and 72. All of the P stages were conducted at 90° C.

TABLE 10

| Sample # | Bleaching Sequence | D Stage | P Stage | Brightness (% GE) | Viscosity (cP) |
|---|---|---|---|---|---|
| 62 | $D_oE_pDP$ | 0.5% CA 1.0% D 70° C., 1.3 hr | 2.0% P 90° C., 3 hrs | 78.0 | 20.4 |
| 63 | $D_oE_pDP$ | 0.5% CA 0.8% D 70° C., 1.3 hr | 2.0% P 90° C., 3 hrs | 80.0 | 18.0 |
| 64 | $D_oE_pDP$ | 0.5% CA 1.0% D 70° C., 2.5 hr | 3.0% P 0.05% $MgSO_4$ 90° C., 3 hrs | 82.7 | 19.4 |
| 65 | $D_oE_pDP$ | 0.5% CA 1.0% D 70° C., 2.5 hr | 3.0% P 0.05% $MgSO_4$ 90° C., 3 hrs | 84.1 | 13.0 |
| 66 | $D_oE_pDP$ | 0.5% CA 1.0% D 70° C., 2.5 hr | 3.0% P 0.05% $MgSO_4$ 90° C., 3 hrs | 84.5 | 12.2 |
| 67 | $D_oE_pDP$ | 0.5% CA 1.0% D 70° C., 2.5 hr CA added after 1.5 hr | 3.0% P 0.05% $MgSO_4$ 90° C., 1.5 hrs | 84.1 | 22.1 |
| 68 | $D_oE_pDP$ | 0.5% CA 1.0% D 70° C., 2.5 hr CA added after 1.5 hr | 3.0% P 0.05% $MgSO_4$ 90° C., 3 hrs | 84.7 | 18.1 |
| 69 | $D_oE_pDP$ | 0.5% CA 1.0% D 70° C., 2.5 hr CA added after 1.5 hr | 3.0% P 0.05% $MgSO_4$ 90° C., 19 hrs | 86.6 | 15.0 |
| 70 | $D_oE_pDP$ | 0.5% CA 1.0% D 70° C., 2.5 hr | 2.5% P 0.05% $MgSO_4$ 90° C., 4 hrs | 82.8 | 20.8 |
| 71 | $D_oE_pDP$ | 0.5% CA 1.0% D 70° C., 2.5 hr | 2.5% P 0.05% $MgSO_4$ 90° C., 4 hrs with 1% silicate | 83.0 | 23.4 |
| 72 | $D_oE_pDP$ | 0.5% CA 1.0% D 70° C., 2.5 hr | same but with 0.3% CA | 82.6 | 25.8 |

The foregoing samples illustrate that use of a chelating agent with a Kappa 30 kraft pulp at a chlorination factor of 0.12 in a $D_0E_pDP$ bleaching process can produce pulp having 80 to 85 % GE brightness with a pulp viscosity of 12 to 26 cP. Use of a magnesium salt and/or silicate may help to maintain a high pulp viscosity.

EXAMPLE XII

In this series of samples, an oxygen delignified Southern (Pine Bluff) softwood pulp having a Kappa number of 29.7 and a viscosity of 33.5 cP was treated with a chlorination factor (C.F.) of 0.2 wt. % in a chlorination stage containing 0.5 wt. % EDTA chelating agent at 60° C. and 10 wt. % consistency. In all of the samples the $E_p$ stage was conducted with 1.8 wt. % sodium hydroxide and 0.6 wt. % peroxide for one hour at 70° C. and 10 wt. % consistency. Magnesium sulfate was added in Samples 76–78 having a P stage. During the P stage, 1 to 1.5 wt. % sodium hydroxide was added to maintain the pH between 10 and 12. Samples 73–75 did not have a P stage. The brightness and viscosity characteristics of the pulp are given in Table 11.

TABLE 11

| Sample # | Bleaching Sequence | D Stage | P Stage | Brightness (% GE) | Viscosity (cP) |
|---|---|---|---|---|---|
| 73 | $OD_oE_pD$ | 0.3% D 70° C. 2.5 hrs | No | 75.0 | 20.8 |
| 74 | $OD_oE_pD$ | 0.75% D 70° C. 2.5 hrs | No | 79.3 | 19.7 |
| 75 | $OD_oE_pD$ | 1.2% D 70° C. 2.5 hrs | No | 81.4 | 18.1 |
| 76 | $OD_oE_pP$ | No | 1% P 90° C., 4 hrs 0.05% $MgSO_4$ | 82.6 | 17.3 |
| 77 | $OD_oE_pP$ | No | 2.5% P 90° C., 4 hrs 0.05% $MgSO_4$ | 84.7 | 14.0 |
| 78 | $OD_oE_pP$ | No | 4% P 90° C., 4 hrs 0.05% $MgSO_4$ | 86.8 | 13.2 |

As illustrated in Samples 76–78, use of a chelating agent in a bleaching sequence containing a P stage results in an increase in brightness versus a bleaching sequence which does not contain a P stage (Samples 73–75). Thus, the present invention provides a means for increasing the efficiency of a peroxide stage in a bleaching sequence. This allows a decreased use of chlorine containing compounds for bleaching the pulp. Accordingly, a decrease in the amount of chlorine compounds used during the bleaching process may result in a significant decrease in the organic chloride content of the pulp and the effluent from the pulp bleaching process.

EXAMPLE XIII

In this series of samples, the effect of the use of a chelating agent added at various stages of the bleaching sequence is illustrated. The pulp was Southern pine brown stock having a Kappa number of 18.3. The bleaching sequence was $D_0E_{0p}DP$. The $D_0$ was conducted with 0.84 wt. % $ClO_2$ at 50° C., 3.5 wt. % consistency and 40 minutes reaction time. The $E_{0p}$ stage conditions were 1.7 wt. % NaOH, 0.4 wt. % peroxide, 80° C., 1 hour reaction time and 10 wt. % consistency. The D stage and P stage were conducted as indicated in Table 12. In Sample #79, no chelating agent was used. In Sample #80, the chelating agent was added in the P stage. Chelating agent was added 1.5 hours after the chlorine dioxide was added in Sample #81. In Sample #82, the pH was adjusted at the end of the D stage from 3 to 1.4 and no chelating agent was added. The operating conditions and results illustrated by this Example are given in Table 12.

TABLE 12

| Stage Conditions | Sample #79 | Sample #80 | Sample #81 | Sample #82 |
|---|---|---|---|---|
| D Stage | | | | |
| $ClO_2$ (wt. %) | 0.6 | 0.6 | 0.6 | 0.6 |
| Temp. (° C.) | 70 | 70 | 70 | 70 |
| consistency (wt. %) | 10 | 10 | 10 | 10 |
| Time (hrs) | 2.5 | 2.5 | 2.5 | 2.5 |
| EDTA (wt. %) | 0 | 0 | 0.4 | 0 |
| Sulfuric Acid (wt. %) | 0 | 0 | 0 | 0.3 |
| End pH | 3.2 | 3.2 | 3.0 | 1.4 |

TABLE 12-continued

| Stage Conditions | Sample #79 | Sample #80 | Sample #81 | Sample #82 |
|---|---|---|---|---|
| P Stage | | | | |
| Peroxide (wt. %) | 1.28 | 1.28 | 1.28 | 1.28 |
| Peroxide consumed (wt. %) | 1.28 | 1.27 | 1.02 | 1.21 |
| NaOH (wt. %) | 1.02 | 1.02 | 1.02 | 1.02 |
| $MgSO_4$ (wt. %) | 0.255 | 0.255 | 0.255 | 0.255 |
| EDTA (wt. %) | 0 | 0.51 | 0 | 0 |
| consistency (wt. %) | 12.8 | 12.8 | 12.8 | 12.8 |
| End pH | 11.0 | 11.1 | 10.9 | 11.0 |
| Brightness (% GE) | 82.6 | 84.6 | 87.4 | 87.4 |
| Reverted Brightness (% GE) | 81.4 | 82.6 | 85.3 | 82.8 |

As illustrated by the foregoing example, Sample #81, adding the chelating agent during the chlorine dioxide bleaching stage and before the peroxide stage provides an unexpected increase in the GE brightness of the pulp and a reduction in the use of peroxide in the peroxide stage.

Although this specification discloses particular embodiments of the invention, the Examples merely describe illustrations of the process of the invention. Those skilled in the art may suggest numerous modifications and substitutions of parts of the invention without departing from the spirit and scope of the invention.

What is claimed is:

1. A method for bleaching a digested kraft pulp containing lignocellulosic fibers with one or more chlorine containing compounds which comprises treating the pulp at a pH within the range of from about 1 to about 6 with a chelating agent during a second chlorine dioxide bleach stage following a first chlorine dioxide-containing bleach stage and, thereafter, as the next and final bleaching stage after the second chlorine dioxide bleach stage, treating the pulp with a peroxide bleach agent, whereby the peroxide-treated pulp exhibits a substantial improvement in viscosity retention and brightness over the same pulp in the absence of treatment with the chelating agent during the second chlorine dioxide bleach stage.

2. The method of claim 1 wherein the consistency of the pulp during bleaching is maintained within the range of from about 0.5% to about 40% by weight.

3. The method of claim 1 wherein the amount of chelating agent ranges from about 0.01 wt. % to about 1.0 wt. % based on the dry weight of pulp being contacted.

4. The method of claim 1 wherein the chelating agent is selected from the group consisting of aminopolycarboxylic acids and aminopolyphosphonic acids and the alkaline metal salts thereof.

5. The method of claim 4 wherein the chelating agent is selected from the group consisting of ethylenediaminetetraacetic acid (EDTA), diethylenetriaminepentaacetic acid (DTPA), nitrilotriacetic acid (NTA), hydroxyethylenediaminetriacetic acid, diethylenetriaminepenta (methylenephosphonic) acid (DTPMA) and the alkali or alkaline earth salts thereof.

6. The method of claim 1 wherein the pulp has a pH in the range of from about 3 to about 6 and is maintained at a temperature the range of from about 35° C. to about 90° C. during treatment with the chelating agent.

7. The method of claim 1 wherein the treatment with the chelating agent is conducted for from about 30 seconds to about 3 hours.

8. The method of claim 1 further comprising contacting the pulp with one or more peroxide stabilizers during treatment with the peroxide bleach agent.

9. The method of claim 1 wherein the pulp to be bleached is an oxygen delignified pulp.

10. The method of claim 1 wherein the bleaching operation further comprises an extraction stage.

11. The method of claim 1 wherein the bleaching operation comprises a first chlorine dioxide bleaching stage, an extraction stage, a second chlorine dioxide bleaching stage, and a peroxide stage.

12. The method of claim 11 wherein the pulp is treated with the chelating agent during both the first chlorine dioxide stage and during the second chlorine dioxide stage.

13. The method of claim 12 further comprising contacting the pulp with one or more peroxide stabilizers.

14. The method of claim 13 wherein the peroxide stabilizers are selected from the group consisting of magnesium sulfate and sodium silicate.

15. A process for bleaching a pulp containing lignocellulosic fibers comprising:

bleaching the pulp with a chlorine-containing compound in an initial bleaching stage;

treating the pulp in an extraction stage following the initial bleaching stage wherein the extraction stage contains oxygen and/or peroxide;

thereafter treating the pulp during a chlorine dioxide bleaching stage or during an optional wash carried out immediately after the chlorine dioxide bleaching stage, at a pH within the range of from about 1 to about 6, with from about 0.01 wt. % chelating agent, based on the dry weight of fibers in the pulp, for a period of time sufficient to substantially improve the brightness of the pulp; and treating the pulp with a peroxide bleach agent in a final bleaching stage subsequent to the chlorine dioxide bleaching stage.

16. The process of claim 15 wherein the amount of chelating agent ranges from about 0.03 wt. % to about 0.5 wt. % based on the dry weight of pulp.

17. The process of claim 15 wherein the chlorine compound is selected from the group consisting of chlorine dioxide, chlorine gas, and a mixture of chlorine dioxide and chlorine gas.

18. The process of claim 15 further comprising treating the pulp with the chelating agent at one or more points during the chlorine dioxide bleaching stage.

19. The process of claim 15 wherein the chelating agent is selected from the group consisting of aminopolycarboxylic acids and aminopolyphosphonic acids and the alkaline metal salts thereof.

20. The process of claim 19 wherein the chelating agent is selected from the group consisting of ethylenediaminetetraacetic acid (EDTA), diethylenetriaminepentaacetic acid (DTPA), nitrilotriacetic acid (NTA), hydroxyethylenediaminetriacetic acid, diethylenetriaminepenta (methylenephosphonic) acid (DTPMA) and the alkali or alkaline earth salts thereof.

21. The process of claim 15 wherein the pulp has a pH in the range of from about 3 to about 6 and is maintained at a temperature in the range of from about 35° C. to about 90° C. during the treatment with the chelating agent.

22. The process of claim 15 wherein the treating step with the chelating agent is conducted for from about 30 seconds to about 3 hours.

23. The process of claim 15 further comprising contacting the pulp with one of more peroxide stabilizers during treatment of the pulp with the peroxide bleach agent.

24. The process of claim 15 further comprising treating the pulp with the chelating agent during the initial bleaching stage.

25. The process of claim 15 wherein the pulp is bleached in a bleaching operation comprising an initial chlorination step, an extraction step, and a peroxide step.

26. The process of claim 15 wherein the pulp is treated with the chelating agent during both the initial chlorine-containing bleaching stage and during the chlorine dioxide stage.

27. The process of claim 26 further comprising contacting the pulp with one or more peroxide stabilizers.

28. The process of claim 27 therein the peroxide stabilizers are selected from the group consisting of magnesium sulfate and sodium silicate.

29. A process for bleaching a digested kraft pulp containing lignocellulosic fibers with chlorine and non-chlorine-containing bleaching agents, wherein the pulp has a consistency in the range of from about 0.5% to about 40%, the process comprising:

bleaching the pulp with chlorine dioxide in a first bleach stage;

treating the pulp in an extraction stage following the first bleach stage wherein the extraction stage contains oxygen and/or peroxide;

treating the pulp during a second chlorine dioxide bleach stage following the extraction stage with a metal chelating agent at a pulp pH ranging from 1 to about 6, wherein the amount of chelating agent is sufficient to substantially reduce an organic halide content of the bleach pulp and wherein the temperature of the pulp during the treating is within the range of from about 35° to about 110° C.; and bleaching the pulp with a peroxide bleach agent in a bleach stage after the second chlorine dioxide bleach stage without any intermediate treatment between the peroxide stage and the second chlorine dioxide stage other than an optional wash.

30. The process of claim 29 wherein the amount of chelating agent ranges from about 0.03 wt. % to about 0.5 wt. % based on the dry weight of pulp.

31. The process of claim 29 wherein the chelating agent is selected from the group consisting of aminopolycarboxylic acids and aminopolyphosphonic acids and the alkaline metal salts thereof.

32. The process of claim 31 wherein the chelating agent is selected from the group consisting of ethylenediaminetetraacetic acid (EDTA), diethylenetriaminepentaacetic acid (DTPA), nitrilotriacetic acid (NTA), hydroxyethylenediaminetriacetic acid, diethylenetriaminepenta (methylenephosphonic) acid (DTPMA) and the alkali or alkaline earth salts thereof.

33. The process of 29 wherein the pulp has a pH in the range of from about 3 to about 6 and a temperature in the range of from about 35° C. to about 90° C. during the second chlorine dioxide bleach stage.

34. The process of claim 29 wherein the second chlorine dioxide bleach stage is carried out for from about 3 seconds to about 3 hours.

35. The process of claim 29 further comprising contacting the pulp with one or more peroxide stabilizers during the bleaching stage employing peroxide.

36. The process of claim 29 further comprising treating the pulp with an amount of chelating agent during the first chlorine-dioxide bleaching stage.

37. A process for bleaching kraft-digested pulp which comprises a sequence of bleach stages selected from the group consisting of $D_0E_{0+p}D_1P$,$D_0E_pD_1P$ and $D_0/C\ E_pD_1P$ with an optional washing step between the $D_1$ and P stages of each wherein a chelating agent is added during the $D_1$ stage and/or during the optional wash between the $D_1$ and P stages in an amount and under conditions which are sufficient to produce a bleached pulp having substantially improved brightness, viscosity and yield as compared to pulp bleached using the same sequences without the chelating agent addition.

38. The process of claim 37 wherein the chelating agent is added during the $D_0$ and $D_1$ stages.

39. The process of claim 37 wherein the optional wash is employed and the pulp is treated with the chelating agent during the wash prior to treatment with the peroxide bleach agent.

* * * * *

UNITED STATES PATENT AND TRADEMARK OFFICE

CERTIFICATE OF CORRECTION

PATENT NO. : 6,706,143 B1
DATED : March 16, 2004
INVENTOR(S) : Ted Y. Tsai

It is certified that error appears in the above-identified patent and that said Letters Patent is hereby corrected as shown below:

Column 14,
Line 60, after "temperature" and before "the" insert -- in --.
Line 61, after "during" and before "treatment" insert -- the --.

Column 15,
Line 28, after "0.01 wt. %" and before "chelating" insert -- to about 1 wt. % --.

Column 16,
Line 10, after "Claim 27" and before "the", delete "therein" and insert -- wherein --.
Line 25, after "from" and before "1", insert -- about --.
Line 27, after "the" and before "pulp", delete "bleach" and insert -- bleached --.
Line 50, after "process of" and before "29", insert -- claim --.
Line 55, after "about" and before "seconds", delete "3" and insert -- 30 --.

Signed and Sealed this

Thirtieth Day of November, 2004

JON W. DUDAS
*Director of the United States Patent and Trademark Office*